US011246405B2

(12) United States Patent
Xi et al.

(10) Patent No.: US 11,246,405 B2
(45) Date of Patent: Feb. 15, 2022

(54) ORAL CARE IMPLEMENT AND SPIRAL BRISTLE FOR USE WITH THE SAME

(71) Applicant: Colgate-Palmolive Company, New York, NY (US)

(72) Inventors: Wen Jin Xi, Shanghai (CN); Bo Zhang, Yangzhou (CN); Guang Sheng Guo, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 102 days.

(21) Appl. No.: 16/061,366

(22) PCT Filed: Dec. 14, 2015

(86) PCT No.: PCT/CN2015/097243

§ 371 (c)(1),
(2) Date: Jun. 12, 2018

(87) PCT Pub. No.: WO2017/100973

PCT Pub. Date: Jun. 22, 2017

(65) Prior Publication Data

US 2018/0360204 A1 Dec. 20, 2018

(51) Int. Cl.

| | |
|---|---|
| ***A46D 1/00*** | (2006.01) |
| ***A46B 9/04*** | (2006.01) |
| *A46D 1/04* | (2006.01) |

(52) U.S. Cl.

CPC ..... *A46D 1/0238* (2013.01); *A46B 9/04* (2013.01); *A46D 1/023* (2013.01); *A46D 1/0261* (2013.01); *A46B 2200/1066* (2013.01); *A46D 1/04* (2013.01)

(58) Field of Classification Search

CPC .... A46D 1/023; A46D 1/0238; A46D 1/0261; A46D 1/02; A46B 9/04; A46B 2200/1066

See application file for complete search history.

(56) References Cited

U.S. PATENT DOCUMENTS

| | | | | |
|---|---|---|---|---|
| 5,985,192 A | | 11/1999 | Weihrauch | |
| 6,141,819 A | | 11/2000 | Driesen et al. | |
| 6,161,243 A | * | 12/2000 | Weihrauch | A46D 1/00 15/167.1 |
| 6,871,373 B2 | * | 3/2005 | Driesen | A46D 1/00 15/167.1 |

(Continued)

FOREIGN PATENT DOCUMENTS

| | | |
|---|---|---|
| CN | 1195973 A | 10/1998 |
| CN | 1209175 A | 2/1999 |

(Continued)

OTHER PUBLICATIONS

Yamada, Kunio, computer generated English translation of JP 2010-125046A, Jun. 2010. (Year: 2010).*

(Continued)

*Primary Examiner* — Laura C Guidotti

(57) ABSTRACT

A spiral bristle (201) includes: a first component (231), a second component (233), and a third component (235), with each of the second and third components (233, 235) wrapping around the first component (231) in a helical and spaced-apart manner, the second and third components (233, 235) isolated from one another by the first component (231). An oral care implement includes the spiral bristle.

10 Claims, 7 Drawing Sheets

(56) References Cited

U.S. PATENT DOCUMENTS

| | | | | |
|---|---|---|---|---|
| 9,681,743 | B2 | 6/2017 | Xi | |
| 2006/0019097 | A1* | 1/2006 | Weihrauch | A46D 1/00<br>428/375 |

FOREIGN PATENT DOCUMENTS

| | | | | |
|---|---|---|---|---|
| CN | 101404912 | | 4/2009 | |
| CN | 204378289 | U | 6/2015 | |
| DE | 19533815 | | 3/1997 | |
| DE | 19942147 | | 3/2001 | |
| GB | 1208293 | | 10/1970 | |
| JP | 2003189943 | | 7/2003 | |
| JP | 2009-125187 | A * | 6/2009 | A61D 1/00 |
| JP | 2010-125046 | A * | 6/2010 | A46D 1/00 |
| JP | WO 2017/155252 | A1 * | 9/2017 | D02G 3/36 |
| WO | 2015085528 | | 6/2015 | |

OTHER PUBLICATIONS

English translation of JP2009-125187A, Yamada, Jun. 2009. (Year: 2009).*

International Search Report and Written Opinion of the International Searching Authority in International Application No. PCT/CN2015/097243, dated Aug. 22, 2016.

* cited by examiner

ORAL CARE IMPLEMENT AND SPIRAL BRISTLE FOR USE WITH THE SAME

BACKGROUND

Presently color is used in individual bristles, which are generally combined into bristle tufts of a toothbrush, to provide the user with an indicator of the wear due to use of the toothbrush. In the case of spiral bristles, the introduction of color for purposes other than to show wear, such as for decorative purposes, can be problematic because bristles on a toothbrush tend to have a small cross sectional diameter, which for some bristles are on the order of 0.5 mm or less. Therefore, decorative color on a toothbrush tends to be created by groupings of bristles having the same coloration, or by larger tooth cleaning elements, which make it easier to introduce coloration due to the larger scale size as compared to an individual bristle.

BRIEF SUMMARY

The present invention is directed to an oral care implement having bristles with components that are combined to create decorative color combinations in individual bristles, and by extension enabling new color features within bristle tufts and on toothbrushes.

In one aspect, the invention can be a spiral bristle comprising: a first component, a second component, and a third component; each of the second and third components wrapping around the first component in a helical and spaced-apart manner, the second and third components isolated from one another by the first component.

In another aspect, the invention can be a method of forming a spiral bristle, the method comprising: a) coextruding first, second, and third components to form a bristle strand in which the second and third components are isolated from one another by the first component, each of the second and third components forming a longitudinal section of an outer surface of the bristle strand; and b) twisting the bristle strand so that each of the second and third components wrap around the first component in a helical and spaced-apart manner; and c) cutting the bristle strand into a plurality of spiral bristles.

In another aspect, the invention can be a spiral bristle comprising: a first component, a second component, and a third component wherein the first component is a first color, the second component is a second color, and a third component is a third color, each of the first, second, and third colors being different from one another; each of the second and third components wrapping around the first component in a helical and spaced-apart manner.

In further aspects, the invention can be an oral care implement comprising: a handle; a head coupled to the handle; and at least one bristle tuft extending from a first surface of the head, the at least one bristle tuft comprising at least one spiral bristle as set forth above.

In a yet further aspect, the invention can be an oral care implement comprising: a handle; a head coupled to the handle; at least one bristle tuft extending from a first surface of the head, the at least one bristle tuft comprising at least one spiral bristle as set forth above, the spiral bristle bent into a U-shape and mounted to the head.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
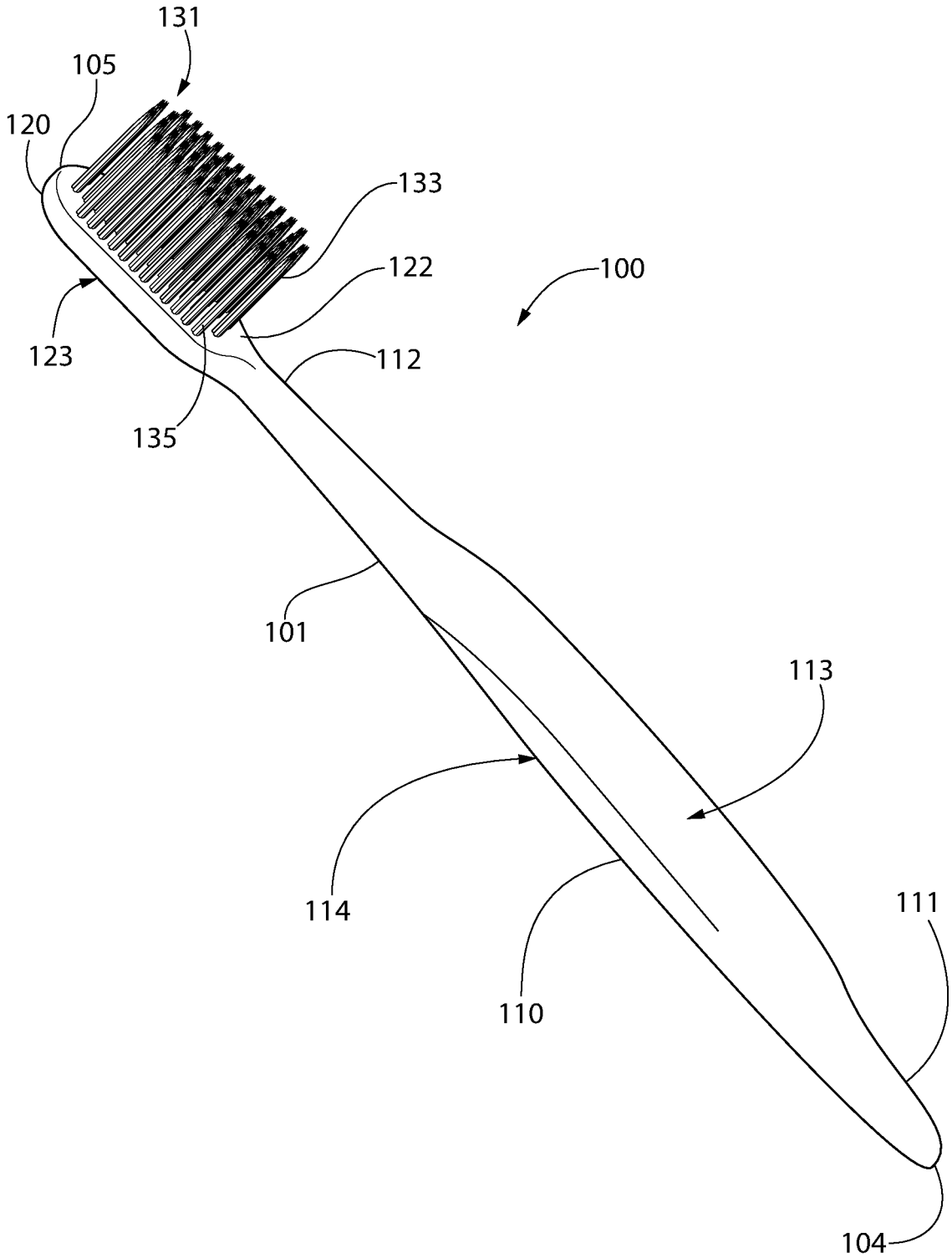
FIG. 1 is a first oral care implement in accordance with an embodiment of the invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as a powered toothbrush. Thus, it is to be understood that the inventive concepts discussed herein can be applied to any type of brushing implement used for oral care, unless a specific type of oral care implement is specified in the claims.

The oral care implement 100 generally includes a body 101 comprising a handle 110 and a head 120. The body 101 generally extends from a proximal end 104 to a distal end 105. In certain embodiments, the body 101 may have a simple linear arrangement, and in certain other embodiments, the body 101 may have a non-linear structure.

The handle 110 extends from a proximal end 111 to a distal end 112 and the head 120 is coupled to the distal end 112 of the handle 110. The handle 110 is an elongated structure that provides the mechanism by which the user can hold and manipulate the oral care implement 100 during use. The handle 110 comprises a front surface 113 and an opposing rear surface 114. The handle 110 may include various contours for user comfort. In certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the oral care implement 100 is coupled to the handle 110 and comprises a front surface 122 and an opposing rear surface 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the oral care implement 100 is provided with a plurality of tooth cleaning elements 131 extending from the front surface 122. Furthermore, in the exemplified embodiment the tooth cleaning elements 131 are illustrated as a plurality of bristle tufts 133, and each bristle tuft 133 is illustrated as a plurality of spiral bristles 135. In certain embodiments the exact structure, pattern, orientation and material of the tooth cleaning elements 131 are not to be limiting of the present invention unless so specified in the claims. In certain embodiments, the tooth cleaning elements 131 may include the bristle tufts 133 along with one or more other types of tooth cleaning elements. As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

In certain embodiments, the bristle tufts 133, and other tooth cleaning elements 131, may be mounted on a head plate that forms part of the head 120 of the oral care implement 100. The head plate is formed separately and, at a later stage of the manufacturing process, is connected to the body 101 at a later stage of the manufacturing process to form the head 120. The head plate may be connected to the body 101, to form the head 120, by any suitable technique known in the art, including without limitation thermal or ultrasonic welding, any fusion techniques such as thermal fusion, melting, a tight-fit assembly, a coupling sleeve, threaded engagement, adhesion, or fasteners. In such an embodiment, the head plate may include a plurality of holes formed therethrough, with the bristle tufts 133 and any other included tooth cleaning elements 131 mounted to the head plate within the holes. This type of technique for mounting the bristle tufts 133 and other tooth cleaning elements to the head 120 via a head plate is generally known as anchor free tufting (AFT). Specifically, in AFT a plate or membrane is created separately from the head 120. The tooth cleaning elements 131 (such as the bristle tufts 133) are positioned into the head plate so as to extend through the head plate. The free ends of the other tooth cleaning elements 131 on one side of the head plate perform the cleaning function. The ends of the tooth cleaning elements 131 on the other side of the head plate are melted together by heat to be anchored in place. After the tooth cleaning elements 131 are secured to the head plate, the head plate is secured to the head 120 such as by ultrasonic welding. In certain embodiments, the portion of the bristle tufts 133 that are melted together comprise the anchor portion of the bristle tufts 133 and individual bristles.

Any suitable technique for attaching the bristle tufts 133 and other tooth cleaning elements 131 to the head may be used in the broad practice of this invention. Specifically, the tooth cleaning elements 131 of the present invention can be connected to the head 120 in any manner known in the art. For example, staples/anchors or in-mold tufting (IMT) could be used to mount the tooth cleaning elements 131. In certain embodiments, various combinations of stapled, IMT or AFT bristles may be used. Alternatively, the bristle tufts 133 may be mounted to tuft blocks by extending through suitable openings in the tuft blocks so that the base of the bristles is mounted within or below the tuft block. Such tuft blocks may then be connected to the body 101 to form the head 120 of the oral care implement 100.

Although not illustrated herein, in certain embodiments the head 120 may also include a soft tissue cleanser coupled to or positioned on its rear surface 123. An example of a suitable soft tissue cleanser that may be used with the present invention and positioned on the rear surface of the head 120 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Figure 2A:
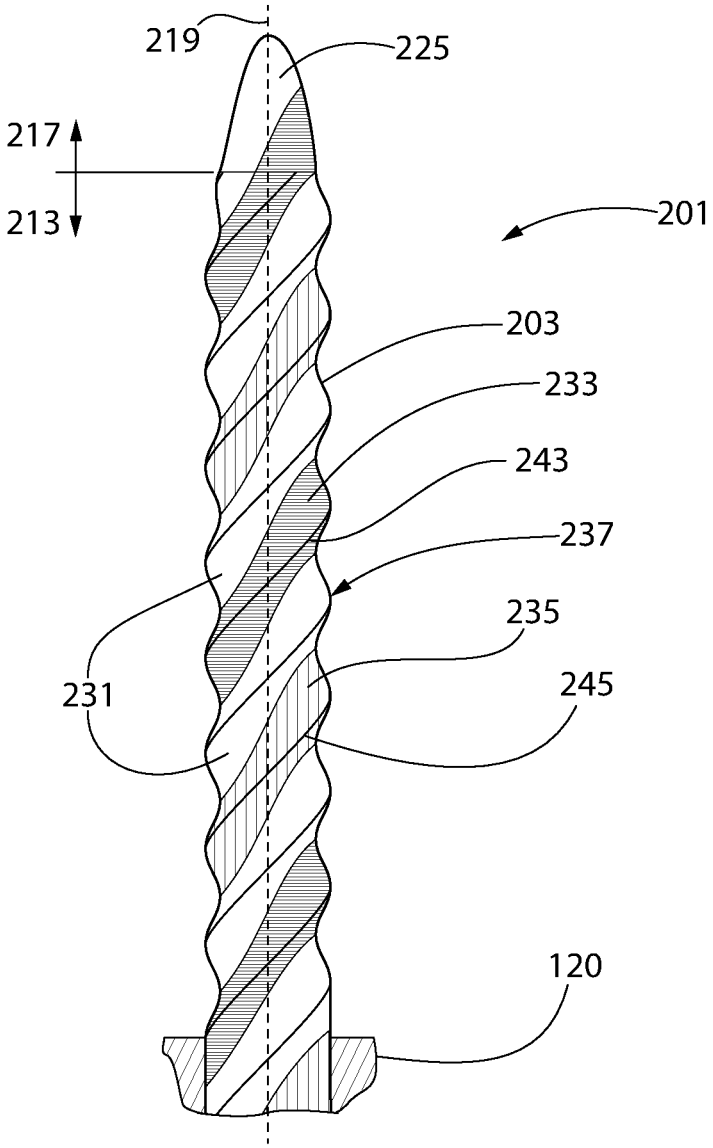
FIG. 2A illustrates a first spiral bristle.
Figure 2B:
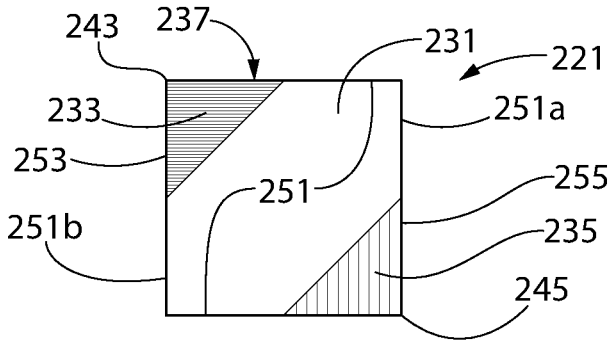
FIG. 2B illustrates a transverse cross-section of the body portion of the spiral bristle of FIG. 2A.

Referring to both FIGS. 2A-2B, an embodiment of a spiral bristle 201 forming a monofilament 203 is shown. The monofilament 203 includes a base portion 213 and a tapered portion 217. The base portion 213 extends into the head 120 to anchor the monofilament 203 to the head 120. The monofilament 203 extends away from the head 120 along a bristle axis 219, and the base portion 213 has a substantially constant transverse cross-sectional profile 221 (as viewed in a plane orthogonal to the bristle axis 219) between the point where the base portion 213 extends out of the head 120 to the tapered portion 217. The transverse cross-sectional profile 221 of the base portion 213 is shown in FIG. 2B. As shown, the transverse cross-sectional profile 221 is a square. In certain other embodiments, the transverse cross-sectional profile 221 may have a geometrical shape other than square, such as a rectangle, a circle, or an ellipse. In certain embodiments, the transverse cross-sectional profile 221 may be any type of polygonal transverse cross-section profile. The tapered portion 217 includes a free end 225 extending longitudinally from the base portion 213. The tapered portion 217 has a transverse cross-section (as viewed in a plane orthogonal to the bristle axis 219) that decreases in size moving from the base portion 213 toward the free end 225.

In certain embodiments, any one end of the spiral bristle 201 may be tapered by briefly immersing an end of the spiral bristle 201 in a bath of a chemical solution, such as a caustic soda (NaOH). When the end is removed from the bath, the tapered portion 217 is formed as shown in FIG. 2A. The length of the tapered portion 217 may be adjusted by the concentration of the chemical solution, immersion time, pulling out speed from the chemical solutions, among other factors. The tapered portion 217 may generally be delineated from the base portion 213 in that the tapered portion 217 is the portion of the spiral bristle 201 that is immersed within the chemical solution.

The spiral bristle 201 includes a first component 231, a second component 233, and a third component 235, with the second and third components 233, 235 isolated from one another by the first component 231. The second and third components 233, 235 are wrapped around the first component 231 in a helical and spaced-apart manner to form the monofilament 203. The helical form of the spiral bristle 201 results in apexes of the transverse cross-sectional profile 221 twisting around the monofilament 203 along the bristle axis 219 of the spiral bristle 201. In certain embodiments, the bristle axis 219 does not intersect either of the second component 233 or the third component 235.

In certain embodiments the first component 231 may be a first color, the second component 233 may be a second color, and the third component 235 may be a third color, with each of the first, second, and third colors being different colors. By forming the spiral bristle 201 with first, second, and third components 231, 233, 235 having such a color variation, the monofilament 203 has a bristle outer surface 237 with a helically striped pattern showing a repeating color sequence (when viewed in a direction parallel to the bristle axis 219) of: the first color, followed by the second color, followed by the first color, followed by the third color. In such an arrangement, the boundary between the respective adjacent components along the bristle axis 219 forms the boundary between the respective colors. While the apexes of the transverse cross-sectional profile 221 may also add to the overall appearance of the monofilament 203, the apexes may provide improvement in tooth cleaning for toothbrushes which include a plurality of spiral bristles 201. Such an improvement in tooth cleaning may be realized from the spiral bristle 201 having more apex edges on all sides of the spiral bristle as compared to bristles having a square cross section with apexes that run parallel to the bristle axis.

In the embodiment shown in FIGS. 2A-B, the first component 231 is positioned at a first apex 243 of the transverse cross-sectional profile 221, and the second component 233 is positioned at a second apex 245 of the transverse cross-sectional profile 221, with the first and second apexes 243, 245 being opposite one another. In certain embodiments, the first and second apexes 243, 245 may be adjacent apexes of the transverse cross-sectional profile 221. In certain other embodiments, one or both of the second and third components may be located within the transverse cross-sectional profile 221 at positions other than at apexes.

Although the second and third components 233, 235 shown in FIG. 2B have triangular cross sections, certain embodiments of the monofilament 203 may include the second and third components 233, 235 having a different cross-sectional shape within the transverse cross-sectional profile 221. Each of the second and third components 233, 235 may have any shape of cross section within the transverse cross-sectional profile 221. Moreover, the shape of the cross section for each of the second and third components 233, 235 may be different from the shape of cross section of the other of the second and third components 233, 235.

As a result of the respective positioning of the first, second, and third components 231, 233, 235 shown in the transverse cross-sectional profile 221 of FIG. 2B, the first component 231 forms a first section 251 of the bristle outer surface 237, with the first section 251 having two separate sub-sections 251*a*, 251*b*, the second component 233 forms a second section 253 of the bristle outer surface 237, and the third component 235 forms a third section 255 of the bristle outer surface 237. Thus, in the transverse cross-sectional profile 221, the sub-sections 251*a*, 251*b* of the first section 251 of the bristle outer surface 237 are located between the second and third sections 253, 255 of the bristle outer surface 237.

The first, second, and third components 231, 233, 235 of the spiral bristle 201 may be formed from a wide variety of synthetic materials which may be coextruded. Examples of materials that may be used to form the spiral bristle 201 include, but are not limited to, plastics, nylon, aramid, and other polyamide resins, polybutylene terephthalate (PBT), polypropylene terephthalate (polytrimethylene terephthalate, PPT or PTT), or polyethylene terephthalate (PET), and other polyester resins, polypropylene (PP), polyethylene (PE) and other polyolefin resins, and other synthetic resins can be used for bristles of a toothbrush.

In certain embodiments, the first component 231 may be a first material, the second component 233 may be a second material, and the third component 235 may be a third material. In certain embodiments, the first, second, and third materials may all be different, yet chemically compatible, materials. In still other embodiments, the first material may be chemically compatible with the second and third materials, with the second and third materials being chemically incompatible with one another.

Coloring agents may be added to any one or more of the first, second, and third materials of the spiral bristle 201. In certain embodiments, the only difference between the first, second, and third materials may be the inclusion of a coloring agent in one or more of the materials, while no coloring agent, or a different coloring agent, is included in the other ones of the materials. The bristle tufts 133, in certain embodiments, may be formed from multiple ones of the spiral bristles 201 that are formed to have the same coloration for first, second, and third materials, or from spiral bristles 201 that have a variety of coloration for one or more of first, second, and third materials. In this way, a greater variety in the coloration of the tooth cleaning elements 131 may be obtained using such multicolored spiral bristles 201. For example, in certain embodiments the coloring agents may be selected so that the colors of the any two of the first, second, and third materials are contrasting or complementary. In certain other embodiments, the coloring agents may be selected so that the colors of any one or more of the first, second, and third materials, impart sentimental meaning to the user of a toothbrush, e.g., the colors are the same as the colors used by a favorite sports team, a high school, a college, a brand (which may be a brand other than the manufacturer or seller of the toothbrush), and the like.

In certain embodiments, the first, second, and third materials may be selected to vary the translucency/opaqueness of one or more of the materials. As used herein, a component forming part of the spiral bristle 201 is translucent when the perceived color results from at least one color of visible light substantially passes through the material. Conversely, as used herein, a material forming part of the spiral bristle 201 is opaque when the perceived color results from at least one color of visible light reflected or scattered off the surface of the component. In certain embodiments, any one or more of the first, second, and third materials forming part of the spiral bristle 201 may be both partially translucent and partially opaque.

Figure 3:
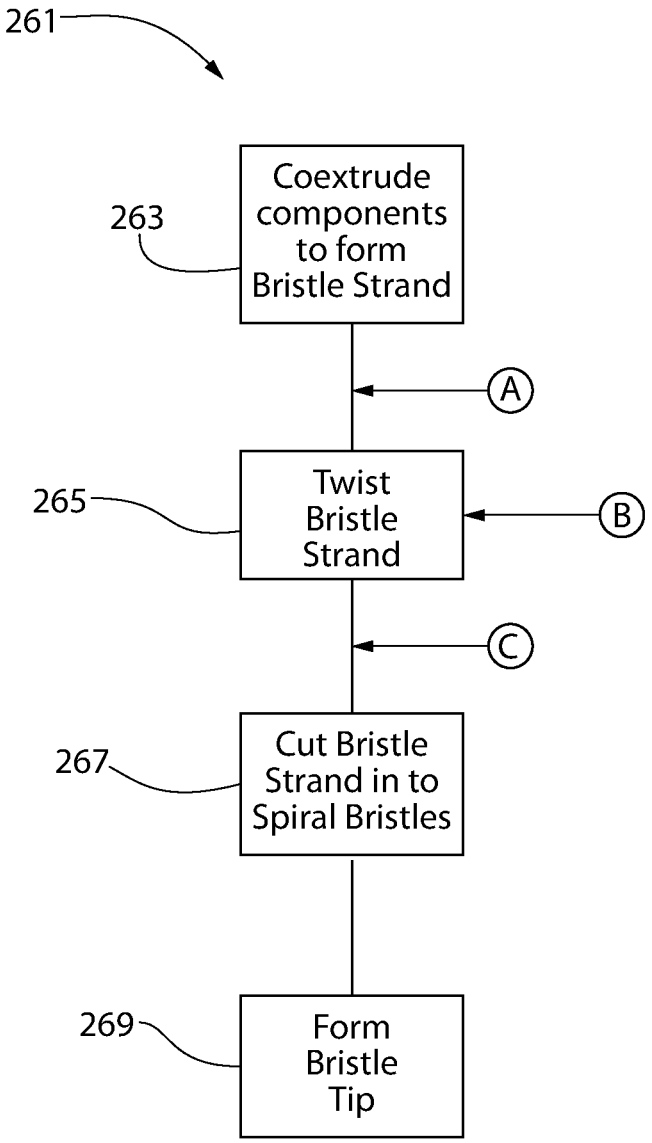
FIG. 3 is a flowchart showing a method of forming a spiral bristle.

A process for forming the spiral bristle 201 of FIG. 2A is illustrated in the flowchart 261 of FIG. 3. In a first step 263, a bristle strand is formed by coextruding the first, second, and third components. The bristle strand has the same cross-sectional profile as shown in FIG. 2B, but the first, second, and third components of the bristle strand do not wrap around each other in a helical manner at this stage of the process. At this stage, the second and third components are isolated from one another by the first component, and each of the second and third components form a longitudinal section of the outer surface of the bristle strand. In a second step 265, the bristle strand is twisted so that each of the second and third components wrap around the first component in a helical and spaced-apart manner. In certain embodiments of the process, a stretching step may be added in which the bristle strand is stretched to increase its length and to decrease its transverse cross-section. In embodiments in which stretching is performed, the stretching may be inserted into the process, as indicated by the optional insertion points in the flowchart 261, prior to A, contemporaneous with B, and/or subsequent to C the twisting step 265. The next step in the process is a cutting step 267, in which the bristle strand is cut into a plurality of spiral bristles. Once cut, a tip forming step 269 is performed to form ends of the spiral bristles into the desired type of tip. For example, one end of the spiral bristles may be formed into an end-rounded tip or a tapered tip. The spiral bristles with formed ends may be mounded to a toothbrush head. In certain embodiments, the spiral bristles may be mounted to a toothbrush head before the tips of the spiral bristles are formed.

Figure 4A:
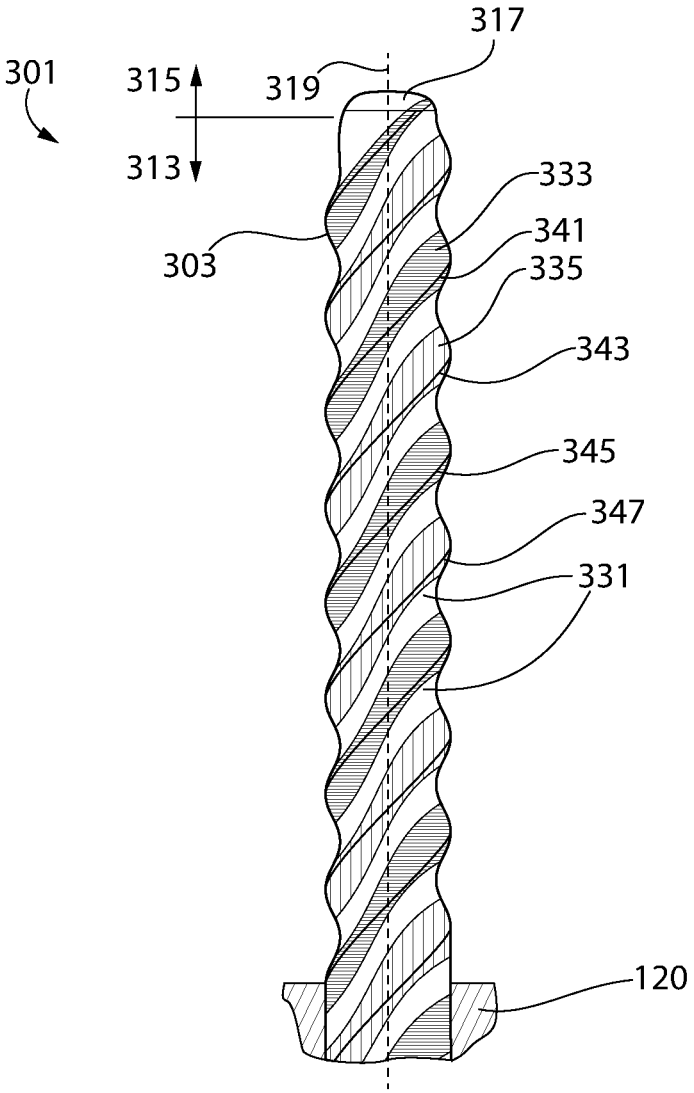
FIG. 4A illustrates a second spiral bristle.
Figure 4B:
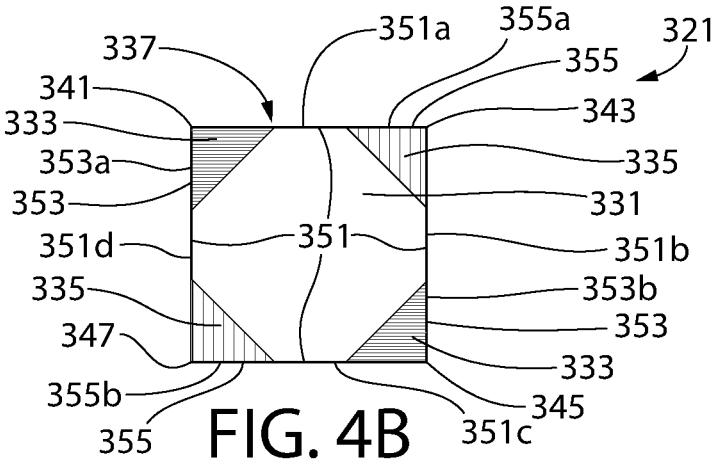
FIG. 4B illustrates a transverse cross-section of the body portion of the spiral bristle of FIG. 4A.

Referring to both FIGS. 4A-B, another embodiment of a spiral bristle 301 forming a monofilament 303 is shown. The monofilament 303 includes a base portion 313 and a tip portion 315. The base portion 313 extends into the head 120 to anchor the monofilament 303 to the head 120. The monofilament 303 extends away from the head 120 along a bristle axis 319, and the base portion 313 has a substantially constant transverse cross-sectional profile 321 (as viewed in a plane orthogonal to the bristle axis 319) between the point where the base portion 313 extends out of the head 120 to a single end-rounded tip 317. The transverse cross-sectional profile 321 of the base portion 313 is shown in FIG. 4B. As shown, the transverse cross-sectional profile 321 is a square. In certain other embodiments, the transverse cross-sectional profile 321 may have a geometrical shape other than square, such as a rectangle, a circle, or an ellipse. In certain embodiments, the transverse cross-sectional profile 321 may be any type of polygonal transverse cross-section profile.

The spiral bristle 311 includes a first component 331, a second component 333, and a third component 335, with the second and third components 333, 335 isolated from one another by the first component 331. The second and third components 333, 335 are wrapped around the first component 331 in a helical and spaced-apart manner to form the monofilament 303. The helical form of the spiral bristle 311 results in apexes of the transverse cross-sectional profile 321 twisting around the monofilament 303 along the bristle axis 319 of the spiral bristle 311. In certain embodiments, the bristle axis 319 does not intersect either of the second component 333 or the third component 335.

In certain embodiments the first component 331 may be a first color, the second component 333 may be a second color, and the third component 335 may be a third color, with each of the first, second, and third colors being different colors. By forming the spiral bristle 311 with first, second, and third components 331, 333, 335 having such a color variation, the monofilament 303 has a bristle outer surface 337 with a helically striped pattern showing a repeating color sequence (when viewed in a direction parallel to the bristle axis 319) of: the first color, followed by the second color, followed by the first color, followed by the third color. In such an arrangement, the boundary between the respective adjacent components along the bristle axis 319 forms the boundary between the respective colors. While the apexes of the transverse cross-sectional profile 321 may also add to the overall appearance of the monofilament 303, the apexes may provide improvement in tooth cleaning for toothbrushes which include a plurality of spiral bristles 301. Such an improvement in tooth cleaning may be realized from the spiral bristle 301 having more apex edges on all sides of the spiral bristle as compared to bristles having a square cross section with apexes that run parallel to the bristle axis.

In the embodiment shown in FIGS. 4A-B, the first component 331 is positioned at first and third apexes 341, 345 of the transverse cross-sectional profile 321, and the second component 333 is positioned at second and fourth apexes 343, 347 of the transverse cross-sectional profile 321, with the first and third apexes 341, 345 being opposite one another, and the second and fourth apexes 343, 347 being opposite one another. In certain embodiments, the second component 333 may be located at adjacent apexes of the transverse cross-sectional profile 321, and likewise the third component 335 may be located at adjacent apexes. In certain other embodiments, one or both of the second and third components 333, 335 may be located within the transverse cross-sectional profile 221 at positions other than at apexes.

Although the second and third components 333, 335 shown in FIG. 4A have triangular cross sections, certain embodiments of the monofilament 303 may include the second and third components 333, 335 having a different cross-sectional shape within the transverse cross-sectional profile 321. Each of the second and third components 333, 335 may have any shape of cross section within the transverse cross-sectional profile 321. Moreover, the shape of the cross section for each of the second and third components 333, 335 may be different from the shape of cross section of the other of the second and third components 333, 335.

As a result of the respective positioning of the first, second, and third components 331, 333, 335 shown in the transverse cross-sectional profile 321 of FIG. 4B, the first component 331 forms a first section 351 of the bristle outer surface 337, with the first section 351 having four separate sub-sections 351*a*, 351*b*, 351*c*, 351*d*, the second component 333 forms a second section 353 of the bristle outer surface 337, with the second section 353 having two separate sub-sections 353*a*, 353*b*, and the third component 335 forms a third section 355 of the bristle outer surface 337, with the third section 355 also having two separate sub-sections 355*a*, 355*b*. Thus, in the transverse cross-sectional profile 321, the four separate sub-sections 351*a*, 351*b*, 351*c*, 351*d* of the first section 351 of the bristle outer surface 337 are, respectively, located between the sub-sections 353*a*, 353*b* of the second section 353 and the sub-sections 355*a*, 355*b* of the third section 355 of the bristle outer surface 337.

In certain embodiments, the first component 331 may be a first material, the second component 333 may be a second material, and the third component 335 may be a third material. In certain embodiments, the first, second, and third materials may all be different, yet chemically compatible, materials. In still other embodiments, the first material may be chemically compatible with the second and third materials, with the second and third materials being chemically incompatible with one another.

Figure 5:
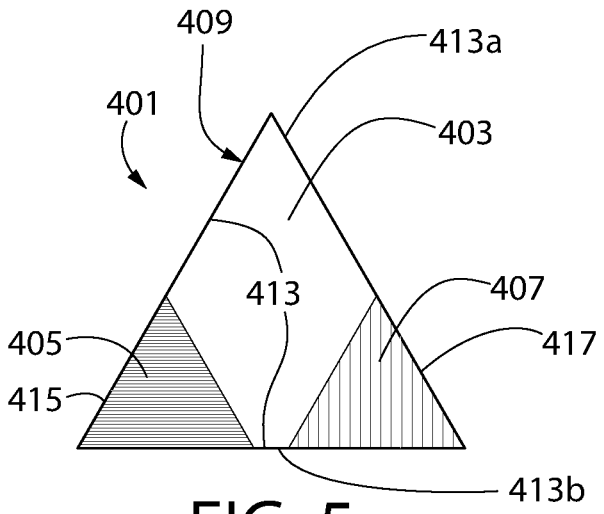
FIG. 5 illustrates a first alternative transverse cross section for a spiral bristle.

An alternative embodiment of a transverse cross-sectional profile 401 for the base portion of a monofilament is shown in FIG. 5. In a monofilament having this type of transverse cross-sectional profile 401, the base portion would include a first component 403, a second component 405, and a third component 407. The three components 403, 405, 407 form a triangular shape for the transverse cross-sectional profile 401, with the second component 405 and the third component 407 being located at two of the apexes of the triangular shape, such that the bristle axis would not intersect the second or third components 405, 407. In certain embodiments, the first component 403 may have a first color, the second component 405 may have a second color, and the third component 407 may have a third color. The shapes of the cross sections for the second and third components 405, 407 may have any shape of cross section within the transverse cross-sectional profile 401, and the shape of the cross section for each of the second and third components 405, 407 may be different from the shape of cross section of the other of the second and third components 405, 407.

As a result of the respective positioning of the first, second, and third components 403, 405, 407 shown in the transverse cross-sectional profile 401 of FIG. 5, in a monofilament having this type of transverse cross-sectional profile 401, the first component 403 forms a first section 413 of the bristle outer surface 411, with the first section 413 having two separate sub-sections 413*a*, 413*b*, the second component 405 forms a second section 415 of the bristle outer surface 411, and the third component 407 forms a third section 417 of the bristle outer surface 411. Thus, in the transverse cross-sectional profile 401, the sub-sections 413*a*, 413*b* of the first section 413 of the bristle outer surface 411 are located between the second and third sections 415, 417 of the bristle outer surface 411.

Figure 6:
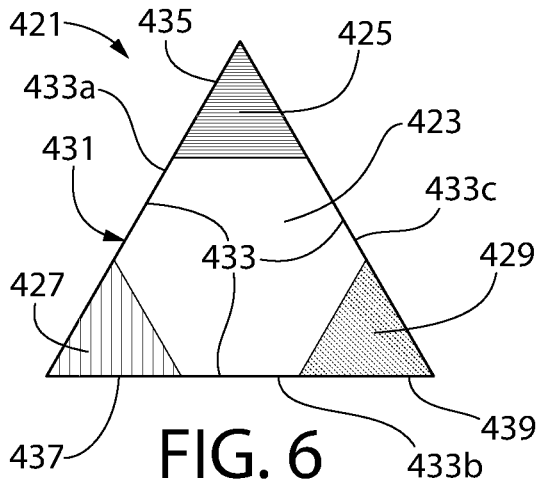
FIG. 6 illustrates a second alternative transverse cross section for a spiral bristle.

An alternative embodiment of a transverse cross-sectional profile 421 for the base portion of a monofilament is shown in FIG. 6. In a monofilament having this type of transverse cross-sectional profile 421, the base portion would include a first component 423, a second component 425, a third component 427, and a fourth component 429. The four components 423, 425, 427, 429 form a triangular shape for the transverse cross-sectional profile 421, with the second, third, and fourth components 425, 427, 429 being located at the three apexes of the triangular shape, such that the bristle axis would not intersect the second, third, or fourth components 425, 427, 429. In certain embodiments, the first component 423 may have a first color, the second component 425 may have a second color, the third component 427 may have a third color, and the fourth component 429 may have a fourth color. The shapes of the cross sections for the second, third, and fourth components 425, 427, 429 may have any shape of cross section within the transverse cross-sectional profile 421, and the shape of the cross section for each of the second, third, and fourth components 425, 427, 429 may be different from the shape of cross section of the others of the second, third, and fourth components 425, 427, 429.

As a result of the respective positioning of the first, second, third, and fourth components 423, 425, 427, 429 shown in the transverse cross-sectional profile 421 of FIG. 6, in a monofilament having this type of transverse cross-sectional profile 421, the first component 423 forms a first section 433 of the bristle outer surface 431, with the first section 433 having three separate sub-sections 433*a*, 433*b*, 433*c*, the second component 425 forms a second section 435 of the bristle outer surface 431, the third component 427 forms a third section 437 of the bristle outer surface 431, and the fourth component 429 forms a fourth section 439 of the bristle outer surface 431. Thus, in the transverse cross-sectional profile 421, the sub-sections 433*a*, 433*b*, 433*c* of the first section 433 of the bristle outer surface 431 are located, respectively, between the second, third, and fourth components 425, 427, 429 of the bristle outer surface 431.

Figure 7:
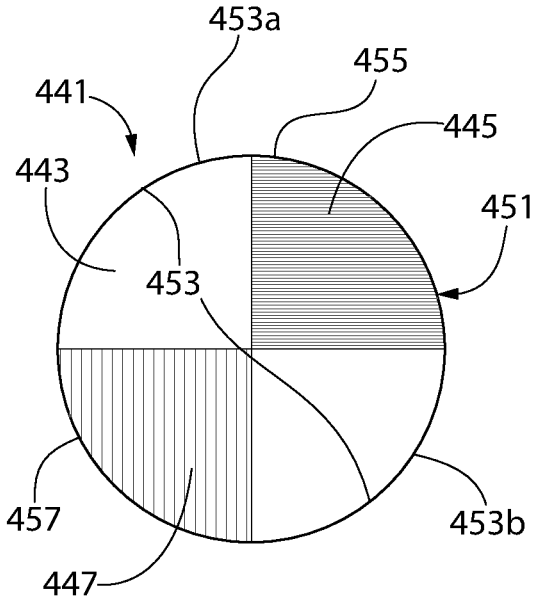
FIG. 7 illustrates a third alternative transverse cross section for a spiral bristle.

An alternative embodiment of a transverse cross-sectional profile 441 for the base portion of a monofilament is shown in FIG. 7. In a monofilament having this type of transverse cross-sectional profile 441, the base portion would include a first component 443, a second component 445, and a third component 447. The three components 443, 445, 447 form a circular shape for the transverse cross-sectional profile 441, with the second component 445 and the third component 447 being located opposite each other in the circular shape. In certain embodiments, the first component 443 may have a first color, the second component 445 may have a second color, and the third component 447 may have a third color. The shapes of the cross sections for the second and third components 445, 447 may have any shape of cross section within the transverse cross-sectional profile 441, and the shape of the cross section for each of the second and third components 445, 447 may be different from the shape of cross section of the other of the second and third components 445, 447. In certain embodiments, the shapes of the second and third components 445, 447 may be made such that the bristle axis would not intersect the second or third components 445, 447.

As a result of the respective positioning of the first, second, and third components 443, 445, 447 shown in the transverse cross-sectional profile 441 of FIG. 7, in a monofilament having this type of transverse cross-sectional profile 441, the first component 443 forms a first section 453 of the bristle outer surface 451, with the first section 453 having two separate sub-sections 453*a*, 453*b*, the second component 445 forms a second section 455 of the bristle outer surface 451, and the third component 447 forms a third section 457 of the bristle outer surface 451. Thus, in the transverse cross-sectional profile 441, the sub-sections 453*a*, 453*b* of the first section 453 of the bristle outer surface 451 are located between the second and third sections 455, 457 of the bristle outer surface 451.

Figure 8:
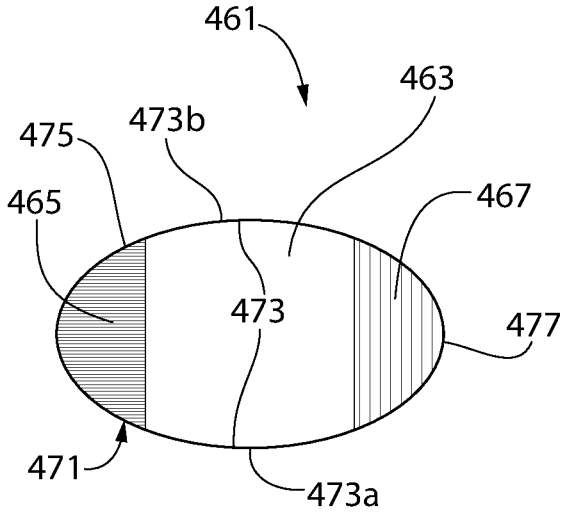
FIG. 8 illustrates a fourth alternative transverse cross section for a spiral bristle.

An alternative embodiment of a transverse cross-sectional profile 461 for the base portion of a monofilament is shown in FIG. 8. In a monofilament having this type of transverse cross-sectional profile 461, the base portion would include a first component 463, a second component 465, and a third component 467. The three components 463, 465, 467 form an elliptical shape for the transverse cross-sectional profile 461, with the second component 465 and the third component 467 being located at the two narrower ends of the elliptical shape, such that the bristle axis would not intersect the second or third components 465, 467. In certain embodiments, the first component 463 may have a first color, the second component 465 may have a second color, and the third component 467 may have a third color. The shapes of the cross sections for the second and third components 465, 467 may have any shape of cross section within the transverse cross-sectional profile 461, and the shape of the cross section for each of the second and third components 465, 467 may be different from the shape of cross section of the other of the second and third components 465, 467.

As a result of the respective positioning of the first, second, and third components 463, 465, 467 shown in the transverse cross-sectional profile 461 of FIG. 8, in a monofilament having this type of transverse cross-sectional profile 461, the first component 463 forms a first section 473 of the bristle outer surface 471, with the first section 473 having two separate sub-sections 473*a*, 473*b*, the second component 465 forms a second section 475 of the bristle outer surface 471, and the third component 467 forms a third section 477 of the bristle outer surface 471. Thus, in the transverse cross-sectional profile 461, the sub-sections 473*a*, 473*b* of the first section 473 of the bristle outer surface 471 are located between the second and third sections 475, 477 of the bristle outer surface 471.

Figure 9:
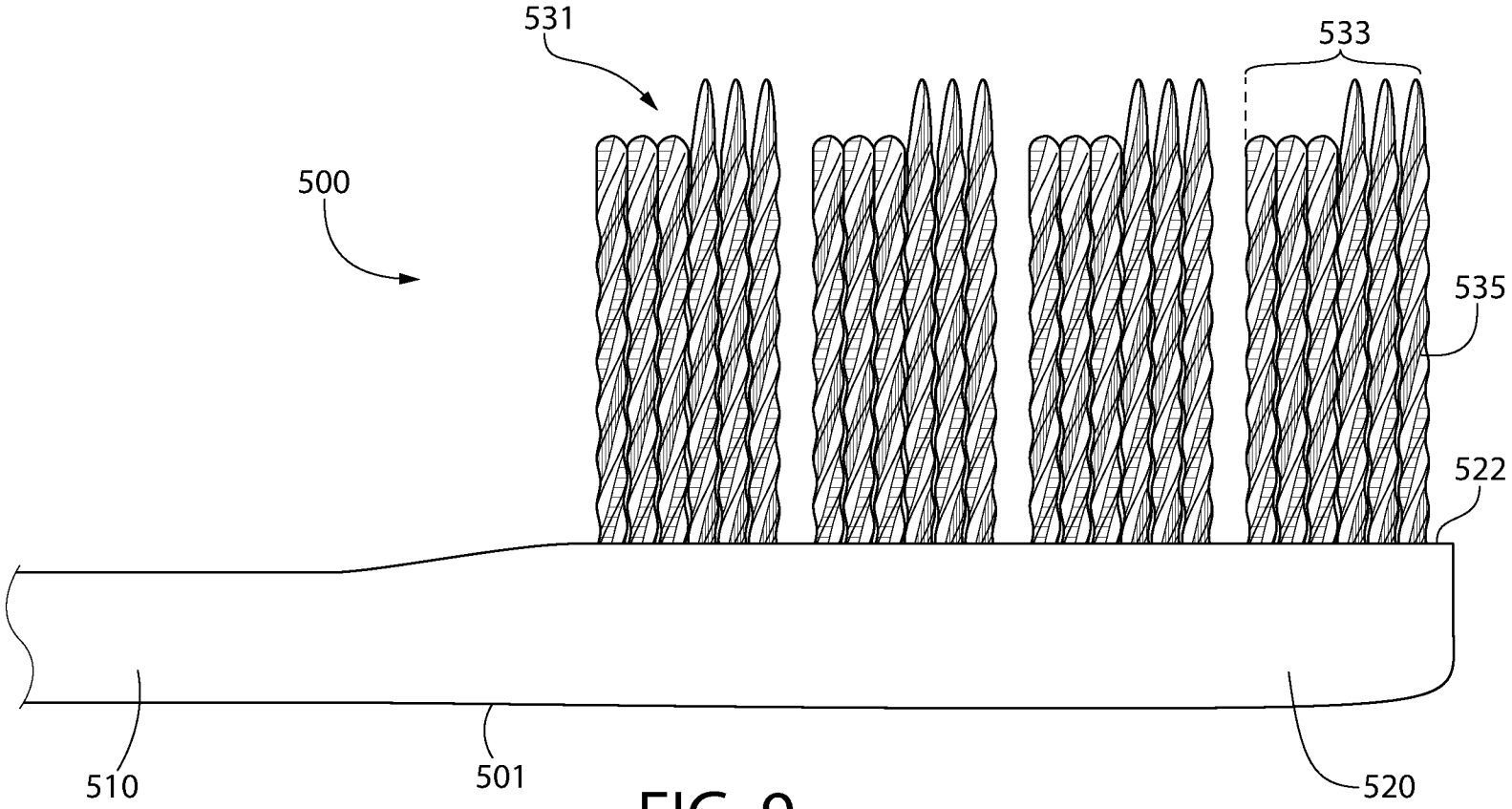
FIG. 9 illustrates a second oral care implement in accordance with an embodiment of the invention.

A second embodiment of an oral care implement 500 is illustrated in FIG. 9. Again, in this exemplified embodiment, the oral care implement 500 is in the form of a manual toothbrush. However, in certain other embodiments the oral care implement 500 can take on other forms such as a powered toothbrush. The oral care implement 500 generally includes a body 501 comprising a handle 510 and a head 520. In this embodiment, the head 520 of the oral care implement 500 is provided with a plurality of tooth cleaning elements 531 extending from the front surface 522. Furthermore, in this embodiment, the tooth cleaning elements 531 are illustrated as a plurality of bristle tufts 533, and each bristle tuft 533 is illustrated as a plurality of spiral bristles 535. In certain embodiments the exact structure, pattern, orientation, and material of the tooth cleaning elements 531 are not to be limiting of the present invention unless so specified in the claims. In certain embodiments, the tooth cleaning elements 531 may include the bristle tufts 533 along with one or more other types of tooth cleaning elements.

Figure 10:
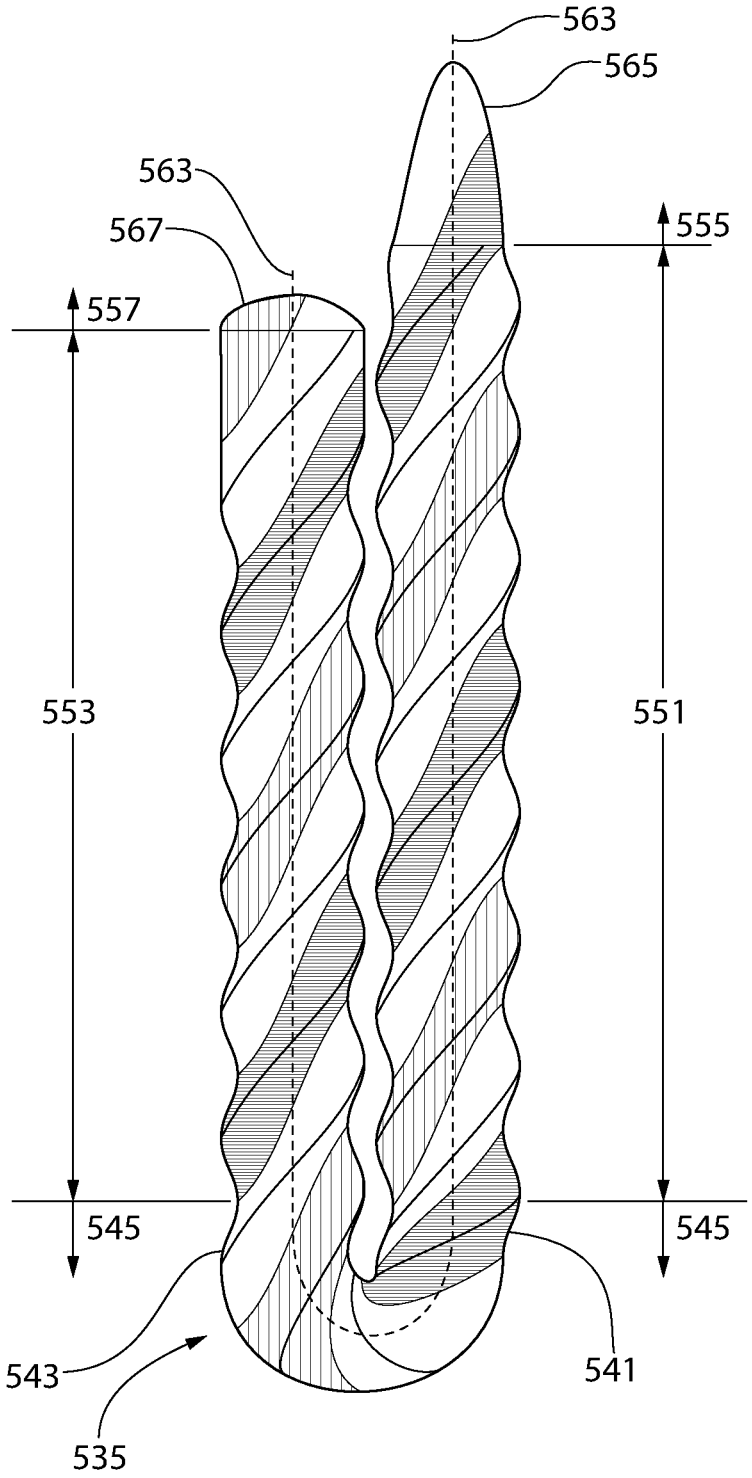
FIG. 10 illustrates a fifth spiral bristle.

In the embodiment shown in FIG. 9, the bristle tufts 533 may be affixed to the head 520 by staples/anchors in a manner that is known in the art. In affixing the bristle tufts 533 in this manner, the spiral bristles 535 which form each bristle tuft 533 may be bent into a U-shape, as shown in FIG. 10. Each U-shaped spiral bristle 535 has two legs 541, 543 which extends away from the head 520 (FIG. 9). The legs 541, 543 share a common anchor portion 545, which is the bottom part of the U-shape that extends into the head 520 and is anchored to the head by the staple/anchor. Each leg 541, 543 includes a base portion 551, 553 and a tip portion 555, 557. The base portions 551, 553 are respectively located between the anchor portion 545 and the tip portions 555, 557, and each base portion 551, 553 extends away from the head 520 along a respective bristle axis 561, 563. In the embodiment depicted, the spiral bristle 535 is bent into the U-shape so one of the legs 541 is longer than the other of the legs 543, so that the tips 565 of the tip portion 555 extend beyond the end-rounded tip 567 of the tip portion 557. In certain other embodiments the legs 541, 543 may be made of equal length, and in still other embodiments, the leg 541 may be shorter than the leg 543.

The base portions 551, 553 of the spiral bristle 535 have a transverse cross-sectional profile, such as any of those shown in FIGS. 2A-B, 4A-B, and 5-9, or any other configuration of transverse cross-sectional profile. Those of skill in the art will recognize that the concepts exhibited by the embodiments shown in FIGS. 2A-B, 4A-B, and 5-9 may be extended into a such a spiral bristle 535. In certain embodiments, concepts exhibited by the embodiments shown in FIGS. 2A-B, 4A-B, and 5-9 may be combined.

The tip portion 555 may be formed with multiple tips 565 by immersing one end of the spiral bristle 535 into a chemical solution, as described above, before the spiral bristle 535 is bent into the U-shape. The tip portion 557 may be formed with a single end-rounded tip 567.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A spiral bristle comprising:

a first component, a second component, and a third component forming a polygonal transverse cross-sectional profile;

each of the second and third components wrapping around the first component in a helical and spaced-apart manner, the second and third components isolated from one another by the first component;

wherein the first, second, and third components are formed of different materials and each one of the first, second, and third components forms an apex of the polygonal transverse cross-sectional profile;

wherein the polygonal transverse cross-sectional profile is a triangle; and wherein the first component forms a truncated diamond shape within the polygonal transverse cross-sectional profile.

2. The spiral bristle according to claim 1 wherein the first component is a first color, the second component is a second color, and a third component is a third color, each of the first, second, and third colors being different from one another.

3. The spiral bristle according to claim 2 further comprising a bristle outer surface having a helically striped pattern comprising a repeating sequence of:

the first color→the second color→the first color→the third color.

4. The spiral bristle according to claim 1 wherein the transverse cross-sectional profile defines a bristle outer surface, the first component forming a first section of the bristle outer surface, the second component forming a second section of the bristle outer surface, and the third component forming a third section of the bristle outer surface; and wherein the first section of the bristle outer surface is located between the second and third sections of the bristle outer surface.

5. The spiral bristle according to claim 1 further comprising a bristle axis; and wherein the bristle axis does not intersect either of the second and third components.

6. The spiral bristle according to claim 1 further comprising a base portion and a tapered portion that terminates in a free end, the base portion having a substantially constant transverse cross-section and the tapered portion having a transverse cross-section that decreases in size moving toward the free end.

7. The spiral bristle according to claim 1 wherein the first, second, and third components are coextruded.

8. The spiral bristle according to claim 1 wherein the first component is formed of a first plastic, the second component is formed of a second plastic, and the third component is formed of a third plastic, the first plastic capable of forming chemical bonds with each of the second and third plastics, and the second and third plastics incapable of forming chemical bonds with one another.

9. The spiral bristle according to claim 1 wherein the first and second components meet at an interface, the interface being flush.

10. An oral care implement comprising:

a handle;

a head;

at least one spiral bristle according to claim 1, the at least one spiral bristle mounted to the head.

* * * * *